US006639355B1

(12) United States Patent
Pennaz et al.

(10) Patent No.: US 6,639,355 B1
(45) Date of Patent: Oct. 28, 2003

(54) MULTIDIRECTIONAL ELECTROLUMINESCENT LAMP STRUCTURES

(75) Inventors: Thomas J. Pennaz, Champlin, MN (US); Gary R. Tucholski, N. Royalton, OH (US); Steven A. Mogensen, Lakeville, MN (US)

(73) Assignee: Morgan Adhesives Company, Stow, OH (US)

( * ) Notice: Subject to any disclaimer, the term of this patent is extended or adjusted under 35 U.S.C. 154(b) by 191 days.

(21) Appl. No.: 09/742,493

(22) Filed: Dec. 20, 2000

Related U.S. Application Data

(60) Provisional application No. 60/172,738, filed on Dec. 20, 1999, provisional application No. 60/172,739, filed on Dec. 20, 1999, and provisional application No. 60/172,740, filed on Dec. 20, 1999.

(51) Int. Cl.[7] ..... H01J 1/62

(52) U.S. Cl. ..... 313/498; 313/506; 313/509; 313/511; 315/169.3

(58) Field of Search ..... 313/498, 502, 313/506, 511, 512, 509, 491, 492, 493, 500; 315/169.3

(56) References Cited

U.S. PATENT DOCUMENTS

| | | | | |
|---|---|---|---|---|
| 3,312,851 A | | 4/1967 | Flowers et al. | 313/108 |
| 3,673,450 A | * | 6/1972 | Leach | 313/506 |
| 3,784,414 A | | 1/1974 | Macaulay et al. | 136/175 |
| 3,889,357 A | | 6/1975 | Millard et al. | 29/570 |
| 4,064,288 A | | 12/1977 | Shah et al. | 427/58 |
| 4,105,807 A | | 8/1978 | Arora | 427/126 |
| 4,159,559 A | * | 7/1979 | Robinson, Sr. | 313/506 |
| 4,277,974 A | | 7/1981 | Karr et al. | 73/339 |
| 4,417,174 A | | 11/1983 | Kamijo et al. | 313/502 |
| 4,482,841 A | * | 11/1984 | Tiku et al. | 313/503 |
| 4,547,703 A | * | 10/1985 | Fujita et al. | 257/43 |
| 4,560,902 A | * | 12/1985 | Kardon | 156/330 |
| 4,624,045 A | | 11/1986 | Ishihara et al. | 29/572 |
| 4,634,934 A | | 1/1987 | Tohda et al. | 315/169 |
| 4,665,342 A | | 5/1987 | Topp et al. | 313/505 |

(List continued on next page.)

OTHER PUBLICATIONS

"EL Technology Provides Innovative Dashboard Lighting for Italian Sports Car" (A Dupont application profile—H78295 3/99).

"Dupont Luxprint Electroluminescent Inks" (L 11263 11/97 Dupont Photopolymer and Electronic Materials).

"A History and Technical Discussion of Electroluminescent Lamps" (Dupont Photopolymer & Electronic Materials).

"Let There Be Light: Screen Printing EL Lamps for Membrane Switches" Ken Burrows of EL Specialists Inc. as printed in the Jan. 1999 issue of "Screen Printing".

"Factors Affecting Light Output Electroluminescene Lamps" Melvyn C. Rendle of Acheson Colloids presented at Jun. 28, 1999 Membrane Switch Symposium.

*Primary Examiner*—Don Wong
*Assistant Examiner*—Ephrem Alemu
(74) *Attorney, Agent, or Firm*—Barnes & Thornburg; Timothy J. Engling

(57) ABSTRACT

The present invention is an EL lamp structure that provides multidirectional light emission from the structure through the use of transparent front and rear electrode layers in the EL lamp structure. By utilizing various printing and depositing methods for the structural component layers of the EL lamp, light emission can be provided from the front and back surfaces of an EL lamp structure as well as a surface of a three-dimensional object.

13 Claims, 2 Drawing Sheets

U.S. PATENT DOCUMENTS 4,666,576 A 5/1987 Pliefke ..... 204/129
4,684,353 A 8/1987 deSouza ..... 445/51
4,721,883 A 1/1988 Jacobs et al. ..... 313/505
4,767,965 A 8/1988 Yamano et al. ..... 313/491
4,816,356 A 3/1989 Balkanski ..... 429/191
4,816,717 A 3/1989 Harper et al. ..... 313/502
4,880,661 A 11/1989 Endo et al. ..... 427/38
4,904,901 A 2/1990 Simoportos et al. ..... 313/509
4,936,924 A 6/1990 Inuzuka ..... 136/249
4,977,007 A 12/1990 Kondo et al. ..... 428/76
4,983,497 A 1/1991 Gilson et al. ..... 430/272
4,999,936 A 3/1991 Calamia et al. ..... 40/544
5,013,967 A 5/1991 Hirotaka et al. ..... 313/512
5,041,326 A * 8/1991 Schroeder et al. ..... 445/35
5,133,036 A * 7/1992 Tornqvist ..... 385/130
5,245,516 A 9/1993 de Haas et al. ..... 362/108
5,250,905 A 10/1993 Kuo et al. ..... 324/435
5,259,778 A 11/1993 Zhang ..... 439/188
5,260,161 A 11/1993 Matsumura et al. ..... 430/161
5,264,714 A 11/1993 Nakaya et al. ..... 257/78
5,268,827 A 12/1993 Granneman et al. ..... 362/156
5,276,382 A * 1/1994 Stocker et al. ..... 250/462.1
5,279,641 A 1/1994 Narisawa et al. ..... 75/353
5,332,946 A 7/1994 Eckersley et al. ..... 313/506
5,338,625 A 8/1994 Bates et al. ..... 429/193
5,339,024 A 8/1994 Kuo et al. ..... 324/435
5,346,770 A * 9/1994 Osada et al. ..... 428/334
5,359,261 A 10/1994 Kondo et al. ..... 313/509
5,396,177 A 3/1995 Kuo et al. ..... 324/435
5,410,217 A 4/1995 LaPointe ..... 313/509
5,411,592 A 5/1995 Ovshinsky et al. ..... 118/718
5,418,062 A * 5/1995 Budd ..... 313/506
5,437,692 A 8/1995 Dasgupta et al. ..... 29/623
5,445,906 A 8/1995 Hobson et al. ..... 429/162
5,469,019 A * 11/1995 Mori ..... 313/502
5,471,773 A 12/1995 Hoffman ..... 40/544
5,482,614 A 1/1996 Kondo et al. ..... 205/171
5,494,699 A 2/1996 Chung ..... 427/66
5,512,147 A 4/1996 Bates et al. ..... 204/192
5,512,389 A 4/1996 Dasgupta et al. ..... 429/192
5,533,289 A 7/1996 Hoffman ..... 40/544
5,552,668 A 9/1996 Hirose et al. ..... 313/506
5,565,733 A * 10/1996 Krafcik et al. ..... 313/506
5,567,210 A 10/1996 Bates et al. ..... 29/623
5,573,807 A 11/1996 LaPointe ..... 427/66
5,596,278 A 1/1997 Lin ..... 324/435
5,597,183 A 1/1997 Johnson ..... 283/83
5,598,058 A 1/1997 LaPointe ..... 313/503
5,612,152 A 3/1997 Bates ..... 429/162
5,621,274 A 4/1997 McGuigan ..... 313/512
5,621,991 A 4/1997 Gustafson ..... 40/544
5,643,685 A 7/1997 Torikoshi ..... 428/690
5,665,490 A 9/1997 Takeuchi et al. ..... 429/192
5,667,417 A 9/1997 Stevenson ..... 445/24
5,680,160 A 10/1997 LaPointe ..... 345/173
5,681,402 A 10/1997 Ichinose et al. ..... 136/256
5,702,565 A * 12/1997 Wu et al. ..... 117/44
5,726,953 A 3/1998 LaPointe et al. ..... 368/67
5,731,105 A 3/1998 Fleischer et al. ..... 429/192
5,770,920 A 6/1998 Eckersley et al. ..... 313/506
5,779,346 A 7/1998 Burke ..... 362/84
5,780,965 A 7/1998 Cass et al. ..... 313/506
5,786,664 A * 7/1998 Liu ..... 313/506
5,789,860 A 8/1998 Inoguchi et al. ..... 313/506
5,797,482 A 8/1998 LaPointe et al. ..... 200/314
5,808,412 A 9/1998 Zovko et al. ..... 313/509
5,821,691 A 10/1998 Richie et al. ..... 313/506
5,830,028 A * 11/1998 Zovko et al. ..... 445/52
5,831,375 A 11/1998 Benson, Jr. ..... 313/110
5,856,029 A * 1/1999 Burrows ..... 313/502
5,917,278 A 6/1999 Miyauchi et al. ..... 313/506
5,957,564 A * 9/1999 Bruce et al. ..... 315/169.3
5,958,610 A 9/1999 Yonekawa et al. ..... 428/690
6,036,823 A * 3/2000 Inoguchi et al. ..... 204/192.15
6,069,442 A 5/2000 Hung et al. ..... 313/504
6,100,478 A 8/2000 LaPointe et al. ..... 200/314
6,288,487 B1 * 9/2001 Arai ..... 313/498
6,411,726 B1 * 6/2002 Pires ..... 313/506

* cited by examiner

MULTIDIRECTIONAL ELECTROLUMINESCENT LAMP STRUCTURES

RELATED U.S. APPLICATION DATA

This application has priority to U.S. provisional applications No. 60/172,738 60/172,739, and 60/172,740, all filed Dec. 20, 1999, and incorporated herein by reference.

BACKGROUND OF THE INVENTION

The present invention relates to electroluminescent (EL) lamps and more particularly to EL lamp structures that allow light to be emitted from the lamp structure in more than one direction. EL lamps are basically devices that convert electrical energy into light. AC current is passed between two electrodes insulated from each other and having a phosphorous material placed therebetween. Electrons in the phosphorous material are excited to a higher energy level by an electric field created between the two electrodes during the first quarter cycle of the AC voltage. During the second quarter cycle of the AC voltage, the applied field again approaches zero. This causes the electrons to return to their normal unexcited state. Excess energy is released in the form of light when these electrons return to their normal unexcited state. This process is repeated for the negative half of the AC cycle. Thus, light is emitted twice for each full cycle (Hz). Various properties of the emitted light can be controlled by varying this frequency, as well as the applied AC voltage. For example, the brightness of the EL lamp generally increases with voltage and frequency.

Prior art EL lamps typically comprise numerous component layers. At the light-emitting side of an EL lamp (typically the top) is a front electrode, which is typically made of a transparent, conductive indium tin oxide (ITO) layer and a silver bus bar to deliver maximum and uniform power to the ITO. Below the ITO/bus bar layers is a layer of phosphor, followed by a dielectric insulating layer and a rear electrode layer. All of these layers are typically disposed on a flexible or rigid substrate. In some prior art EL lamps, the ITO layer is sputtered on a polyester film, which acts as a flexible substrate. A relatively thick polyester film, typically four or more mils thick, is necessary because of the screen printing of the layers. The EL lamp construction may also include a top film laminate or coating to protect the component layers of the EL lamp construction.

Prior art EL lamps that emit light from the front and the back surfaces of the lamp are typically constructed simply by joining two separate unidirectional EL lamps back-to-back. Unfortunately, this type of construction has an increased overall thickness as compared to a single EL lamp. Furthermore, the power requirements for this type of back-to-back EL lamp are about twice that of a single EL lamp and the cost of manufacturing is almost double that of a single EL lamp.

The power constraint is a significant limitation :in small and lightweight electronic applications where small dry cells, such as button, coin or cylindrical cells, must be used. These constraints are even further limiting in applications where light emission in several directions is desired.

It is therefore an object of the present invention to provide a multidirectional EL lamp structure that provides light emission in two opposing directions without utilizing two separate EL lamp structures in a back-to-back configuration. it is also an object of the present invention to provide a multidirectional EL lamp structure that provides light emission in two opposing directions without a significant increase in the overall thickness of the EL lamp structure.

It is a further object of the present invention to provide an alternate EL lamp structure that provides multidirectional light emission from the surface of a three-dimensional object.

These and other objects and advantages of the invention will be apparent from the following description, the accompanying drawings and the appended claims.

SUMMARY OF THE INVENTION

The present invention is an EL lamp structure that provides light emission from the front and back surfaces of the structure without utilizing two separate EL lamp structures in a back-to-back configuration. The EL lamp utilizes a transparent electrode layer, such as printable indium tin oxide (ITO), for both the front and the rear electrode layers of the EL lamp. Thus, emitted light is visible from both the front and the rear of the EL lamp through the transparent electrode layers.

In multidirectional EL lamp structure of the present invention, a phosphor layer is printed on the front side of a flexible dielectric film substrate. A front and rear transparent electrode layer, such as printable indium tin oxide (ITO), is printed on the phosphor layer and on the back surface of the dielectric film, respectively. An ITO sputtered polyester film can also be used so that the back surface of the dielectric film does not have to be printed with the ITO ink in order to create a rear transparent electrode layer. A front bus bar is then printed on the front transparent electrode layer. If the rear transparent electrode layer is printed ITO, a back bus bar is printed on the back transparent electrode layer. If sputtered ITO film is used for the back electrode, then a back bus bar may not be needed due to the typical higher conductivity of the sputtered ITO as compared to the printed ITO. The front and rear bus bars are typically printed with silver or carbon ink or combination of both. The application of a top and/or bottom laminate, lacquer, or the like is optional and helps protect the EL lamp structure from adverse environmental conditions, normal wear and tear, and electrical. hazards. A laminate or similar coating will particularly protect the phosphor layer from moisture damage.

In an alternate embodiment, a multidirectional EL lamp structure provides multidirectional light emission from the surface of a three-dimensional object. The three-dimensional object can take any form and is made of a conductive material, such as carbon, metal, plated plastic, or the like. The three-dimensional object acts as both a rear electrode and a substrate for the remaining layers of the EL lamp structure. A dielectric layer, such as barium titanate, is applied to the outside surface of the object. A phosphor layer is applied to the dielectric layer. A transparent electrode layer is then applied to the phosphor layer. After the transparent electrode layer is applied, a front bus bar and/or electrode contact is applied to the ITO portion of the three-dimensional object.

DETAILED DESCRIPTION OF THE INVENTION

While the present invention will be described fully hereinafter with reference to the accompanying drawings, in which a particular embodiment is shown, it is to be understood at the outset that persons skilled in the art may modify the invention herein described while still achieving the desired result of this invention. Accordingly, the description that follows is to be understood as a broad informative disclosure directed to persons skilled in the appropriate art and not as limitations of the present invention.

Figure 1:
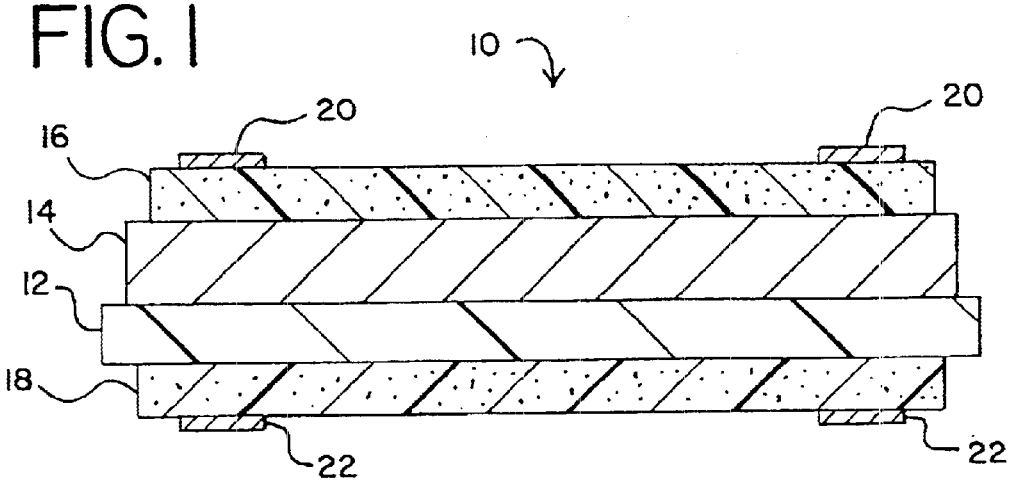
FIG. 1 is a cross-sectional side view of a first embodiment of a multidirectional EL lamp structure that provides light emission from both the front and back surfaces of the structure.

FIG. 1 shows a basic multidirectional EL lamp 10 constructed according to the present invention that provides light emission from the front and rear surfaces of the EL lamp 10. In this embodiment, the EL lamp 10 utilizes a flexible dielectric film 12, such as polypropylene, polyethylene or polyethylene terephthalate (PET), that acts as a combination dielectric layer and structural substrate for the remaining layers of the structure of the EL lamp 10. Other films that may make acceptable dielectric films include polycarbonate, KAPTON by E. I. Du Pont de Nemours and Co., polysulfone, polystyrene and impregnated film. A PET film is preferred, but polypropylene is acceptable where the factors of film thickness and the dielectric constant are balanced to select the desired film. The dielectric film 12 is rigid enough to act as a substrate. The flexible dielectric film 12 also possesses suitable dielectric properties for EL lamp applications. Depending on various design parameters, the light output will vary considerably relative to the thickness of the dielectric layer and its dielectric constant at a given operating voltage and frequency. Typically, a thicker dielectric layer will require a higher operating voltage to achieve a given lamp brightness. Furthermore, the higher the dielectric constant of the material, the greater the brilliance of the lamp. In any given EL lamp design, it is important to maintain an effective dielectric layer to prevent voltage breakdown between the electrodes of the EL lamp, which results in lamp malfunction and/or failure.

A layer of phosphor 14 is printed on the dielectric film. 12. Printable phosphor compositions are available to emit light in many colors, such as green, blue, or yellow. Phosphor compositions can also be blended or dyed with a fluoro dye to produce a white light. Typical EL phosphors are a zinc sulfide-based material doped with the various compounds to create the desired color. The phosphor layer 14 is printed by rotary screen printing, flexographic printing, or other high-speed printing methods. The printed phosphor layer 14, which also acts as a secondary dielectric layer, must be smooth and consistent in, order to ensure a uniform lighting effect from the excited phosphor. As opposed to a printed dielectric surface used in prior art structures, the dielectric film 12 provides a smooth surface for the application of the phosphor layer 14. This smooth surface promotes an evenly distributed printed phosphor layer 14 and thus provides a higher quality lighting effect.

A front transparent electrode layer .16 is disposed on the phosphor layer 14, as shown in FIG. 1. A rear transparent electrode layer 18 is disposed on the bottom surface of the dielectric film 12, as shown in FIG. 1. In a preferred embodiment, the front and rear transparent electrode layers 16 and 18 are conductive indium tin oxide (ITO) layers. The front transparent electrode layer 16 together with the rear transparent electrode layer 18 disposed on the bottom (back) of the dielectric film layer 12 provide two parallel conductive electrodes that create the capacitance required for the excitation of the phosphor layer 14 during operation of the EL lamp 10. The emitted light is visible through both the front and rear transparent electrode layers 16 and 18 A front bus bar 20 is printed on the front transparent electrode layer 16 and provides a means for electrically connecting the transparent electrode. In a similar fashion, a rear bus bar 22 is printed on the rear transparent electrode layer 18. In the embodiment of FIG. 1, the rear transparent electrode layer 18 can be printed on a dielectric film 12 with a transparent conductive material, such as ITO. The bus bars 20 and 22 (often called goal posts when EL lamps are rectangular in shape) are printed with a carbon, silver, or other conductive ink in a narrow border that is similar to the perimeter of the printed ITO. As shown in FIG. 1, the conductive layers (electrodes and bus bars) can be indented so as to minimize the chances of the electrodes being directly opposite each other on opposite sides of the dielectric film in case of printing mis-registration in the printing process.

A transparent laminate, lacquer, or the like 98 can be applied to the top and/or bottom of the EL lamp structure in order to protect the EL lamp structure from adverse environmental conditions. A laminate or similar coating will particularly protect the phosphor layer 14 from moisture damage. The life and light-emitting capabilities of the phosphor layer 14 are reduced by exposure to moisture. Alternately, a formulation of phosphor ink that has phosphor particles encapsulated in silica can also be used to minimize moisture damage. The silica is a moisture barrier and does not adversely affect the light-emitting capability of the phosphor when exposed to the electric field generated between the electrodes of the EL lamp.

The resulting multidirectional EL lamp 10 provides light emission from the front and rear surfaces of the EL lamp 10 while only using one layer of phosphor 14. Light emitted from both surfaces uses nearly the same power as a single light-emitting surface. As opposed to folded or back-to-back EL configurations, the production costs are less because two separate production runs are not required. Also, it is less costly due to the elimination of many of the layers, which include one phosphor, two rear electrodes, and two dielectric layers. The resulting multidirectional EL lamp 10 uses less power than a folded or back-to-back EL configuration.

The use of a flexible dielectric film 12 in an EL lamp embodiment as shown in FIG. 1 eliminates the need for a separate dielectric layer and substrate layer in the EL lamp structure. Furthermore, the use of the dielectric film 12 also eliminates, the need to dispose several printed dielectric layers on a substrate, as in prior art EL lamp structures. The elimination of these printed layers increases the quality of the dielectric layer by reducing the possibility of manufacturing defects during the printing process. Appearance defects and pinholes or other voids can occur in the dielectric layer if this layer is printed. These pinholes can cause electrical shorting between the front transparent electrode layer 16 and the rear electrode layer 18 and can result in malfunctioning or failure of the lamp. Cracking and other inconsistencies, such as inconsistent thickness, can also occur when layers are printed on top of another layer. This ultimately affects the quality of subsequently printed component layers, especially the printed phosphor layer 14. Furthermore, the elimination of several printed layers noted earlier also greatly reduces the production time required to manufacture printed EL lamps. The overall production cycle time of an EL lamp is reduced due to a decrease in the required printing and drying times for each of the individual printed layers. Also, due to the elimination of the five different layers, a material savings is also realized. These two factors allow this present invention to have an economic advantage as compared to the prior EL lamp art.

Figure 2:
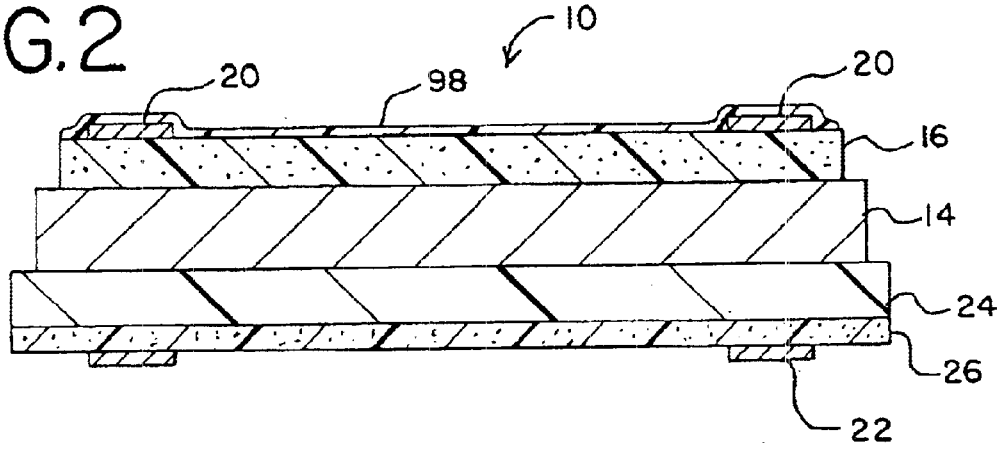
FIG. 2 is an alternate embodiment of the multidirectional EL lamp structure of FIG. 1.

FIG. 2 shows a slightly modified structure of that in FIG. 1. In FIG. 2, the rear transparent electrode layer 18 and the dielectric film 12 of the EL lamp 10 depicted in FIG. 1 are integrated tog ether in the form of a sputtered ITO polyester film 24 having a sputtered ITO layer 26 on the bottom surface of the film 24. The sputtered ITO layer 26 acts as a rear transparent electrode layer of the EL lamp structure. Due to the higher conductivity of the sputtered ITO, thickness of the dielectric layer and its dielectric constant a rear bus bar 22 may not be needed.

Figure 3:
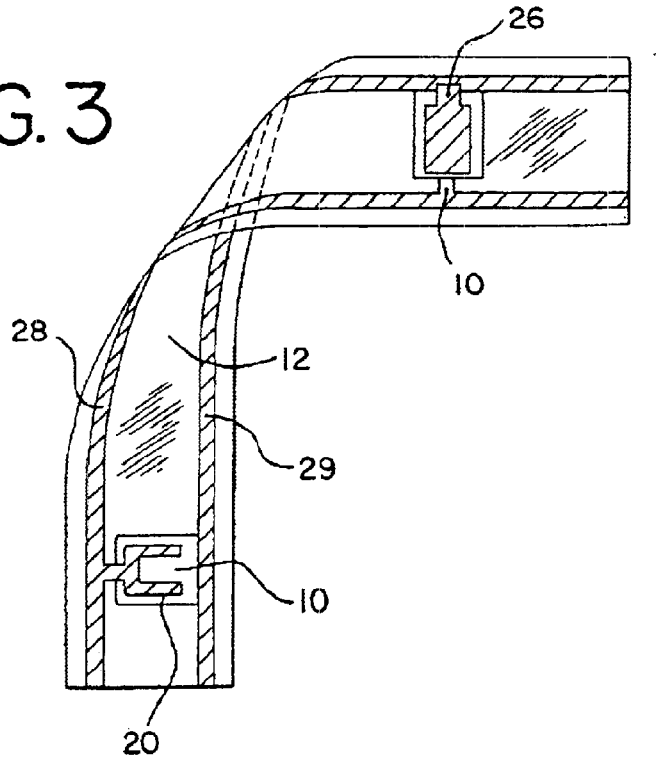
FIG. 3 is an application of the multidirectional, EL lamp structure of FIG. 2 as shown as holiday lights.

FIG. 3 shows an application of the multidirectional EL lamp structure of FIG. 1 as holiday lights. In this embodiment, a dielectric film 12 is provided in the form of a strip or ribbon. A string of EL lamps 10 is created by printing the component layers of the EL lamp structure of FIG. 1 at-discrete portions along the length of the dielectric film ribbon 12. Depending on the lamp size in these ribbons as well as the number of lamps, it is possible that, either or both the front and back bus bars may be eliminated and the front and back printed ITO layers of EL lamps 10 would be directly connected in parallel across a front electrical trace 28 and a rear electrical trace 29 that both run along the length of the dielectric film ribbon 12. If the lamp size is large or if there is a great number of lamps resulting in a large area of EL lamps, then the front and back bus bars would be required to uniformly carry the power to each lamp. The dielectric film ribbon 12 may be tinted red or green, in combination with printable white phosphor composition, each lamp will emit a red or green light. Similarly, the dielectric film ribbon 12 may be tinted blue in combination with the printable white phosphor composition, each lamp will emit a blue light. Also it is intended that any color of film ribbon 12 can be used in combination with the white phosphor and all of the lamps in that ribbon will emit light that is the same color of the ribbon. Also, the entire ribbon of lights could be colored in the printing process in conjunction with a cleat ribbon. Each lamp could be tinted with an individual color or all of the lights could be tinted with the same color. This can be done by using a tinted clear ink such as manufactured by Sun Chemical. Such a ribbon of lights can be easily unrolled on any item to be illuminated, such as a tree, and both sides of the ribbon will illuminate and can be further decorated by printing the appropriate graphics on both sides along the entire length of the ribbon. When rolled, the ribbon of lamps will not tangle as conventional lights.

Figure 4:
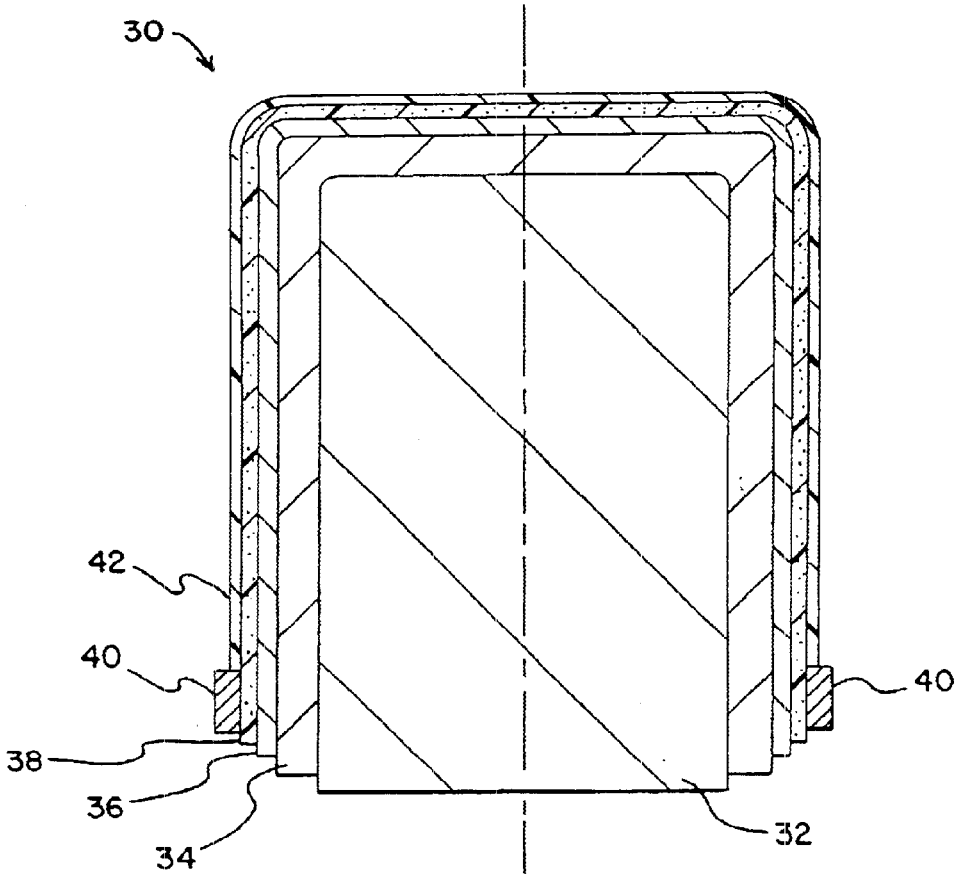
FIG. 4 is a cross-sectional side view of an alternate embodiment of a multidirectional EL lamp structure that provides multidirectional light emission from a cylinder surface.

FIG. 4 shows an alternate embodiment multidirectional EL lamp structure 30 that provides multidirectional light emission from the surface of a three-dimensional object 32. The three-dimensional object 32 shown in FIG. 4 is a cylinder. However, any three-dimensional object shape can be used, such as a statue. The three-dimensional object 32 is made of a conductive material, such as carbon, metal, plated plastic, or the like. The three-dimensional object 32 acts as both a rear electrode and a substrate for the remaining layers of the EL lamp structure 30. A dielectric layer 34, such as barium titanate, is applied to the outside surface of the object. A phosphor layer 36 is then applied to the dielectric layer 34. A front transparent electrode layer 38 is then applied to the phosphor layer 36. After the front transparent electrode layer 38 is applied, a front bus bar and/or electrode contact 40 is applied at a hidden portion of the three-dimensional object 32, which is preferably applied at the top or bottom of the object 32 so that it does not interfere with the light emitted from the object 32, but allows it to uniformly carry the lamps power over the entire area of the ITO FIG. 4 shows a protective laminate coating 42 that is applied to the front transparent electrode layer 38 except at the electrode-contact point. The protective coating 42 can be used for safety from electrical hazards, and it also serves to protect the EL lamp structure 30 from adverse environmental conditions. All of the aforementioned layers can be applied by ionic charge deposition, vacuum deposition, printing, spraying, dipping, or the like.

The nominal voltage and frequency for the EL lamps described herein are typically 115 Volts (AC) and 400 Hz. However, these EL lamps can be made for operation from approximately 40–200 Volts (AC) and 50–5000 Hz. The EL lamps can be operated directly from an AC power source or from a DC power source. If a DC power source is used, such as small batteries, an inverter is required to convert the DC current to AC current. In larger applications, a resonating transformer inverter can be used. This typically consists of a transformer in conjunction with a transistor and resistors and capacitors. In smaller applications, such as placement on PC boards having minimal board component height constraints, an IC chip inverter can generally be used in conjunction with capacitors, resistors and an inductor.

Various properties of the emitted light from the EL lamp can be controlled by varying the frequency as well as the applied AC voltage. For example, the brightness in general of the EL lamp increases with increased voltage and frequency. Unfortunately, when the operating voltage and/or frequency of an EL lamp are increased, the life of the EL lamp will decrease. Therefore, in addition to various other design constraints, these properties must be balanced against the desired product life of the EL lamp to determine the proper operating voltage and/or frequency. In considering these variables, it is important to prevent voltage breakdown across the electrodes of the EL lamp, which results in lamp malfunction or failure.

Although the preferred embodiment of the invention is illustrated and described in connection with a particular type of components, it can be adapted for use with a variety of EL lamps. Other embodiments and equivalent lamps and methods are envisioned within the scope of the invention. Various features of the invention have been particularly shown and described in connection with the illustrated embodiments of the invention, however, it must be understood that these particular embodiments merely illustrate and that the invention is to be given its fullest interpretation within the terms of the appended claims.

What is claimed is:

1. An electroluminescent lamp that emits light from the lamp in more than one direction comprising:

a single dielectric film having a front surface and a back surface;

a phosphor layer on a discrete portion of the front surface of the dielectric film;

a front transparent electrode layer on the phosphor layer;

a front bus bar on the front transparent electrode layer for electrically connecting the front transparent electrode; and a rear transparent electrode on the back surface of the dielectric film;

wherein the front electrode layer together with the rear electrode provide two parallel conductive electrodes that create the capacitance required for the excitation of the phosphor layer during operation of the lamp;

wherein emitted light is visible through both the front and rear transparent electrodes.

2. The lamp of claim 1 further comprising a rear bus bar on the rear transparent electrode.

3. The lamp of claim 1 wherein phosphor particles of phosphor layer are encapsulated in silica.

4. The lamp of claim 1 further comprising a protective laminate as an outermost layer.

5. The lamp of claim 1 further comprising a protective lacquer as an outermost layer.

6. The lamp of claim 1 wherein the front and rear transparent electrodes are conductive indium tin oxide.

7. An electroluminescent lamp that emits light from the lamp in more than one direction comprising:

a single film having a front surface and a back surface with a sputtered indium tin oxide layer;

a phosphor layer on a discrete portion of the front surface of the film;

a front transparent electrode on the phosphor layer; and a front bus bar in a pattern on the front transparent electrode layer for electrically connecting the front transparent electrode;

wherein the front electrode together with the sputtered indium tin oxide provide two parallel conductive electrodes that create the capacitance required for the excitation of the phosphor layer during operation of the lamp.

8. A series of electroluminescent lamps that emit light from the lamps in more than one direction comprising:

a strip of dielectric film having a front surface and a back surface;

a front electrical trace and a rear electrical trace that both run along the dielectric film strip;

a series of lamps are disposed at discrete portions along the dielectric film strip; each lamp including a phosphor layer on the front surface of the dielectric film;

a front transparent electrode on the phosphor layer; and a rear transparent electrode on the back surface of the dielectric film;

wherein each front electrode together with each rear electrode provide two parallel conductive electrodes that create the capacitance required for the excitation of the phosphor layer;

wherein the front and rear electrodes of the lamps are connected in parallel across the front electrical trace and the rear electrical trace;

wherein emitted light is visible through both the front and rear transparent electrodes.

9. The series of lamps of claim 8 wherein each lamp has a front bus bar in a pattern on each front transparent electrode for electrically connecting each front transparent electrode.

10. The series of lamps of claim 8 further comprising a rear bus bar on each rear transparent electrode.

11. The series of lamps of claim 8 wherein phosphor particles of phosphor layer are encapsulated in silica.

12. The series of lamps of claim 8 further comprising a protective laminate as an outermost layer.

13. The series of lamps of claim 8 further comprising a protective lacquer as an outermost layer.

* * * * *